United States Patent [19]

Wessel et al.

[11] 4,250,848

[45] Feb. 17, 1981

[54] FUEL INJECTION SYSTEM

[75] Inventors: Wolf Wessel, Oberriexingen; Gerhard Stumpp; Volkhard Stein, both of Stuttgart, all of Fed. Rep. of Germany

[73] Assignee: Robert Bosch GmbH, Stuttgart, Fed. Rep. of Germany

[21] Appl. No.: 4,239

[22] Filed: Jan. 17, 1979

[30] Foreign Application Priority Data

Feb. 11, 1978 [DE] Fed. Rep. of Germany ..... 2805844

[51] Int. Cl.³ ..... F02M 39/00

[52] U.S. Cl. ..... 123/452; 261/44 A; 261/50 A; 123/454

[58] Field of Search ..... 123/139 AW, 139 BG, 123/139 BC, 140 MC; 261/44 R, 44 A, 50 A

[56] References Cited

U.S. PATENT DOCUMENTS

| | | | |
|---|---|---|---|
| 4,018,200 | 4/1977 | Stumpp et al. | 123/139 AW |
| 4,105,000 | 8/1978 | Wessel et al. | 261/44 A |
| 4,134,379 | 1/1979 | Stumpp | 123/139 AW |
| 4,161,935 | 7/1979 | Eckert et al. | 123/139 AW |

FOREIGN PATENT DOCUMENTS

| | | | |
|---|---|---|---|
| 2739140 | 3/1979 | Fed. Rep. of Germany | 123/139 AW |

*Primary Examiner*—Tony M. Argenbright
*Assistant Examiner*—Magdalen Moy
*Attorney, Agent, or Firm*—Edwin E. Greigg

[57] ABSTRACT

A fuel injection system for controlling a mixture-compressing, externally ignited internal combustion engine which includes a fuel apportionment valve controllable by means of an air flow rate meter, with the fuel pressure upstream of the apportionment point being variable by means of a pressure regulating valve having a movable valve member which separates two chambers connected by a throttle point, and wherein the fuel pressure upstream of the fuel apportionment valve is exerted on one side of the movable valve member, and the force of a spring and a control pressure, which is variable by means of a control element in accordance with operating characteristics of the internal combustion engine, are exerted on the other side of the movable valve member to thereby intervene easily in order to vary the fuel-air mixture using small control forces.

9 Claims, 6 Drawing Figures

FUEL INJECTION SYSTEM

BACKGROUND OF THE INVENTION

The invention relates to a fuel injection system for a mixture-compressing, externally ignited, internal combustion engine.

A fuel injection system is already known in which an intervention is made at a pressure regulating valve having a movable valve member in order to vary the fuel-air mixture, but large adjustment forces are required to produce a relatively large stroke of the movable valve member. This, in turn, requires the utilization of control magnets of large volume and mass, which are therefore difficult to include in the system because of space limitations.

OBJECT AND SUMMARY OF THE INVENTION

The fuel injection system in accordance with the invention has the advantage over the prior art in that an opportunity for intervention is provided, so that it is possible to vary the fuel-air mixture using small forces.

By means of the novel arrangement of the invention, advantageous further embodiments and improvements of the fuel injection system are possible.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
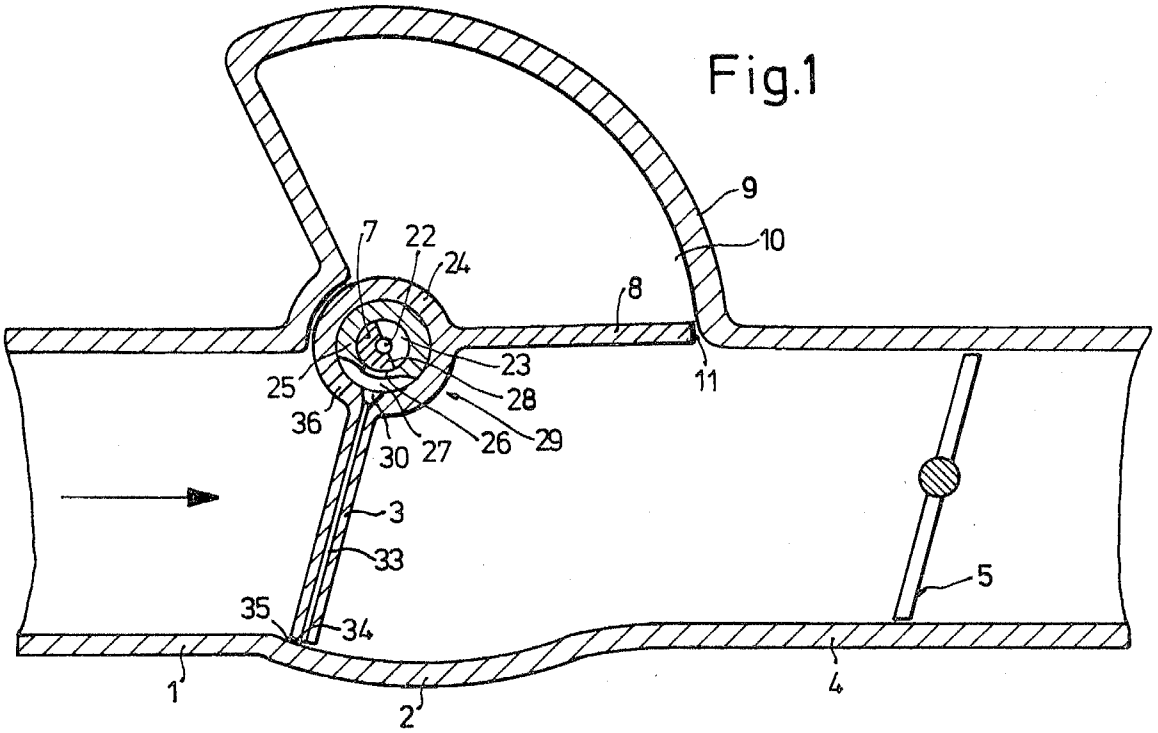
FIG. 1 is an enlarged sectional view of a fuel injection system taken along the line I—I of FIG. 2 in the direction of the arrows.

Referring now to FIG. 1, in the fuel injection system shown, the air required for combustion flows in the direction of the arrow into an air intake manifold 1, which has a section 2 with an air flow rate meter disposed therein, the air flow rate meter being embodied as a barrier valve 3. The air flows further through a section 4 with an arbitrarily actuatable throttle valve 5 to one or more cylinders (not shown) of an internal combustion engine. The air flow rate meter embodied as a barrier valve 3 moves within the complementally curved section 2 of the air intake manifold 1 according to a nearly linear function of the quantity of air flowing through the air intake manifold. Thus, with a constant air pressure prevailing upstream of the air flow rate meter 3, the pressure prevailing between the air flow rate meter and the throttle valve 5 also remains constant. The air flow rate meter 3 is rotatably fixed about a rigid bearing shaft 7 disposed transversely to the air intake manifold and is provided with a damping valve 8.

When the air flow rate meter 3 makes an opening movement, the damping valve 8 moves into a damping section 9 of the air intake manifold. The chamber 10 formed by the damping valve 8 and the damping section 9 communicates with the air intake manifold downstream of the air flow rate meter 3 via a narrow gap 11 between the front face of the damping valve 8 and the wall of the damping section 9. By means of the damping valve, it is assured that intake manifold pressure fluctuations arising from the intake strokes have practically no influence on the angular setting of the air flow rate meter 3.

Figure 2:
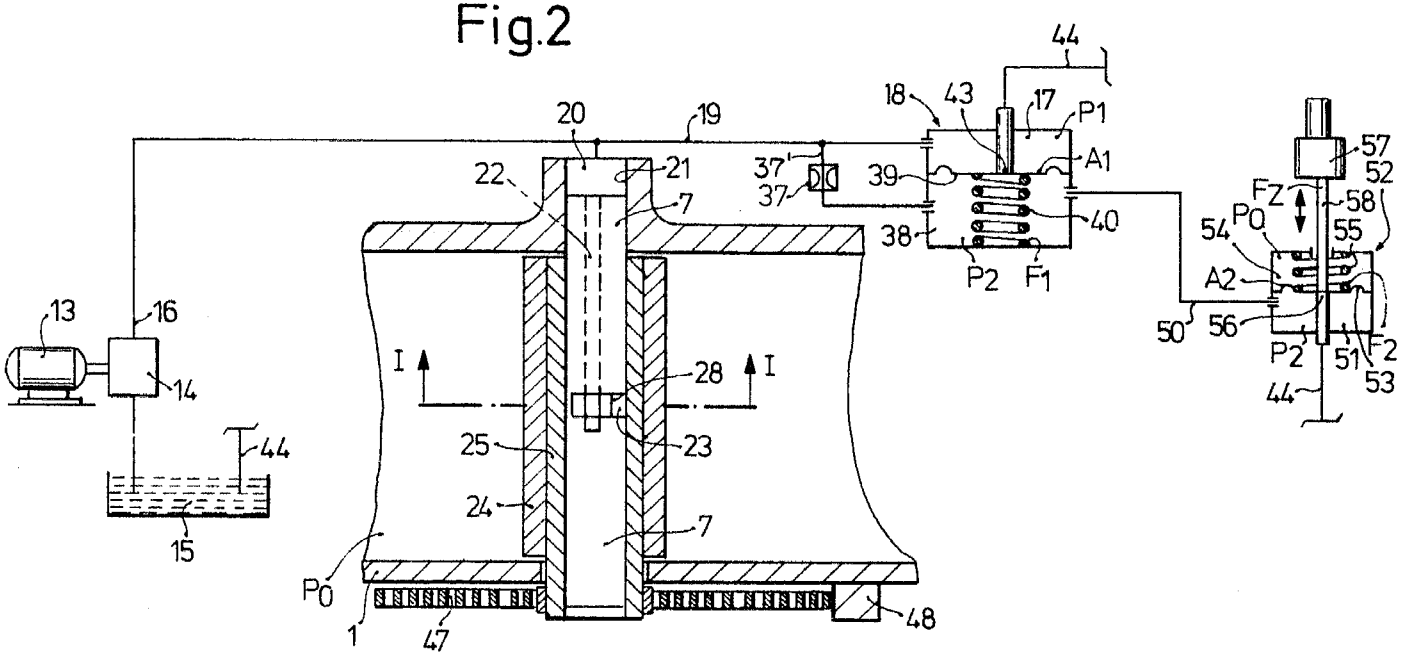
FIG. 2 is a plan view of fuel injection apparatus illustrating one embodiment of the fuel pressure control means of the invention.

As is shown in FIG. 2, the fuel supply is provided by a fuel pump 14 driven by an electric motor 13 which draws fuel from a fuel container 15 and delivers it through a line 16 to a chamber 20, which is formed by the front face of the bearing shaft 7 and the guide bore 21 of the bearing shaft. The chamber 20 communicates with a control groove 23 machined into the bearing shaft 7 via a bore 22 indicated in FIG. 2 by broken lines.

The air flow rate meter 3 and the damping valve 8 are disposed on a bearing hub 24 which is fixedly connected with a sleeve 25 which is rotatable on the bearing shaft 7. A control slit 26 is machined in the sleeve 25 and discharges into a groove 27 of the sleeve 25. The control slit 26 cooperates with a control edge 28 which is formed by the limiting surface of the control groove 23, which is itself formed by the bearing shaft. As a result of the control edge 28, the control slit 26 is opened to a greater or lesser degree depending on the setting of the air flow rate meter 3, so that a quantity of fuel can be apportioned which is proportional to the quantity of air induced by the internal combustion engine.

The control edge 28 and the control slit 26 comprise a fuel apportionment valve 29 disposed within the bearing shaft 7 of the air flow rate meter 3. The apportioned fuel proceeds via the groove 27 into a tapered line section 30 which discharges at its narrower end into an injection line 33 disposed in the axis of the air flow rate meter 3. The injection line 33 discharges at the front face of the air flow rate meter 3 via an injection nozzle 34 into the gap 35 between the front face and the wall of the intake manifold section 2 in the region of highest air flow speed.

The groove 27 communicates with the intake manifold section 1 upstream of the air flow rate meter 3 via an air opening 36. Thus, downstream of the fuel apportionment point, the intake manifold pressure upstream of the air flow rate meter prevails as a counterpressure. The injection line 33 may also communicate, in a manner which is not illustrated, with a plurality of injection nozzles 34 disposed in the front face of the air flow rate meter 3. Also, an injection gap extending over nearly the entire width of the front face of the air flow rate meter 3 may serve as the injection nozzle 34. Further, the injection nozzle 34 may be replaced, in a manner which is not shown, by an injection valve.

The apportionment of fuel at the fuel apportionment valve 29 takes place at a pressure differential which is kept constant at any given time. To this end, a line 19 branches off from the line 16 and discharges into a chamber 17 of a pressure regulating valve 18. A diaphragm 39 separates the chamber 17 of the pressure regulating valve 18 from a chamber 38. The chambers 17 and 38 communicate via a line 37' with a throttle point 37. The pressure regulating valve 18 is urged in the closing direction by a spring 40 which is disposed in the chamber 38.

The pressure regulating valve 18 is embodied as a flat seat valve with the diaphragm 39 as the movable valve member and a fixed valve seat 43 through which fuel can proceed into a return flow line 44 which discharges into the fuel container 15.

The air flow rate meter 3 is deflected against the force of a spiral spring 47, which is connected at one end with the sleeve 25 and at the other end with a stop 48 on the air intake manifold. The basic setting of the fuel apportionment valve 29 may be varied by means of rotating the bearing shaft 7.

As is shown in FIG. 1, the groove 27 communicates with an air opening 36 which discharges into the air intake manifold 1 upstream of the air flow rate meter 3. The use of the intake manifold pressure upstream of the air flow rate meter 3 as a counterpressure at the apportionment point, via the air opening 36, has the advantage not only of providing better preparation of the apportioned fuel with air but also that operation can take place with an open injection nozzle.

The control pressure chamber 38 of the pressure regulating valve 18 communicates via a control pressure line 50 with a chamber 51 of a control valve 52 serving as a control element. The chamber 51 of the control valve 52 is separated by a diaphragm 53 from a chamber 54 in which a spring 55 is disposed which acts upon the diaphragm 53. This chamber 54 communicates with the atmosphere or with the intake manifold pressure upstream of the air flow rate meter 3. The diaphragm 53, embodied as the movable valve member, cooperates with a fixed valve seat 56 disposed within the chamber 51. Fuel can proceed through this valve seat 56 into the return flow line 44 and to the fuel container 15. A supplementary force dependent on operating characteristics of the engine can also act upon the diaphragm 53, for example, via an electromagnet 57 which contacts the diaphragm 53 via an actuation pin 58. The magnetic force may be variable, for example, in accordance with the signal of an oxygen sensor disposed within the exhaust gas line of the engine.

The pressure $p_1$ prevails in the chamber 17 of the pressure regulating valve 18, while the control pressure $P_2$ prevails in the control pressure chamber 38. If the diaphragm 39 of the pressure regulating valve 18 has a surface area $A_1$ and the spring 40 has a force $F_1$, then the resultant pressure difference is:

$$p_1-p_2=F_1/A_1.$$

This pressure difference may be chosen to be as small as desired and is constant.

If the surface area of the diaphragm 53 of the control valve 52 is designated $A_2$, the force of the spring 55 as $F_2$, the supplementary force exerted by the electromagnet 57 as $F_z$, and the pressure in the intake manifold 1 upstream of the air flow rate meter as $P_o$, which approximately prevails in the chamber 54 of the control valve 52 as well, then the fuel pressure drop at the control slit 26 of the fuel apportionment valve 29 is:

$$p_1-p_o=F_1/A_1+(F_z+F_2)/A_2.$$

Thus, the pressure difference $p_1-p_o$ is dependent upon $(F_z+F_2)$ and can be influenced by the supplementary force $F_z$. Since the pressure difference $p_1-p_2=F_1/A_1$ always drops at the throttle point 37, the quantity of fuel flowing through the throttle point 37 is always constant and may also be chosen to be as small as desired. By this means, it is possible to embody the control valve 52 with a small valve seat 56 and a small diaphragm surface area $A_2$. The diaphragm stroke can also be kept small since it needs to compensate only for the pressure variation $p_2$ when the supplementary force $F_z$ is varied.

The small diaphragm surface $A_2$ and thus the small force $(F_2+F_z)$ therefore permit the insertion of small electromagnets to provide the supplementary force $F_z$ for the purpose of varying the fuel-air mixture, while the spring force $F_2$ serves as the basic setting for the leanest fuel-air mixture. The small required diaphragm stroke also permits a very small size electromagnet to be used.

In place of the electromagnet, an element operating in accordance with temperature may also be used, such as an expansible element or bimetallic element, which exerts its force via the actuation pin 58. This provides for a richer fuel-air mixture during the warm-up phase of the engine. A plurality of supplementary forces $F_z$, which are dependent on various operating parameters of the engine, may also be exerted independently of each other on the diaphragm 53 in order to influence the fuel-air mixture.

Further possible means for influencing the fuel pressure are schematically illustrated in FIGS. 3–6, parts of which are the same as those in FIGS. 1 and 2 and are given the same reference numerals.

Figure 3:
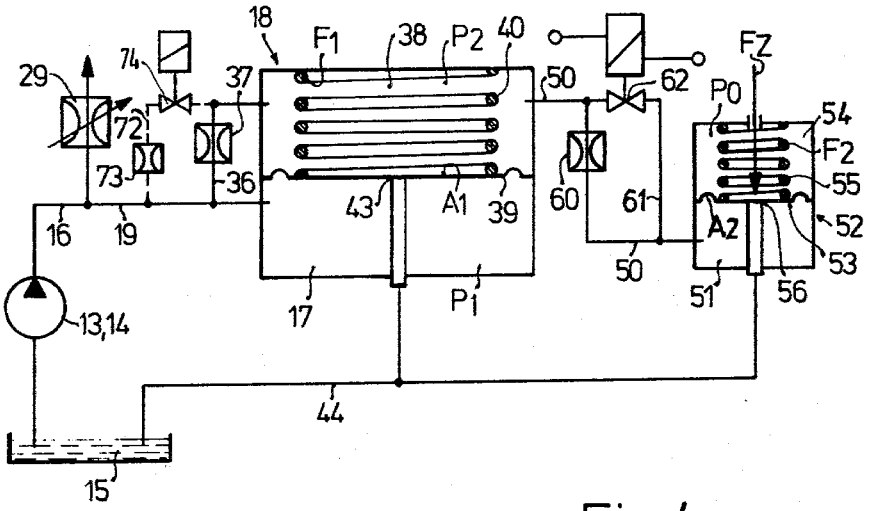
FIG. 3 is a view similar to FIG. 2 showing a second embodiment of the fuel pressure control means of the invention.

In the second embodiment, as shown in FIG. 3, a throttle point 60 is disposed within the control pressure line 50, with an electromagnetic valve 62 disposed parallel to it within a bypass line 61. The electromagnetic valve 62 may be actuated cylically in accordance with the operating characteristics of the engine and briefly closes the throttle point 60 when it is opened. Then the pressure drop at the control slit 26 of the fuel apportionment valve is:

$$P_1-p_0=F_2/A_2+F_1/A_1.$$

When the electromagnetic valve 62 is closed, the pressure difference at the fuel apportionment valve is:

$$p_1-p_o=F_2/A_2+F_1/(A_1\cdot K).$$

where K determines which portion of $(p_1-p_o)$ falls at the throttle point. The value of K is set by the choice of dimensions for the throttle points 37 and 60.

By selecting desired trigger pulse duty cycles in accordance with operating characteristics of the engine, on the average, any desired intermediate value between these two differential pressure limits may be selected. A constant fuel quantity again flows past the throttle point 37, as in the embodiment of FIG. 2, so that the pressure difference $F_1/A_1$ is set. Then the control valve 52 has only a constant quantity which it is required to regulate and, accordingly, it may be commensurately small.

Instead of influencing the duty cycle at the electromagnetic valve 62, a small supplementary force $F_z$ may be exerted on the diaphragm 53 of the control valve 52 for the purpose of enrichment during the warm-up phase, and this force may be supplied, for example, by an element which operates in accordance with temperature.

A modified embodiment, indicated in FIG. 3 by broken lines, is provided when the electromagnetic valve 62 in the bypass line 61 is omitted and a bypass line 72 bypassing the throttle point 37 is provided with a throttle 73 disposed in series with an electromagnetic valve 74. Then favorable conditions are provided for the regulation of the air ratio during filling or emptying of the control pressure chamber 38 and there is a linear air ratio characteristic curve with respect to the duty cycle.

Figure 4:
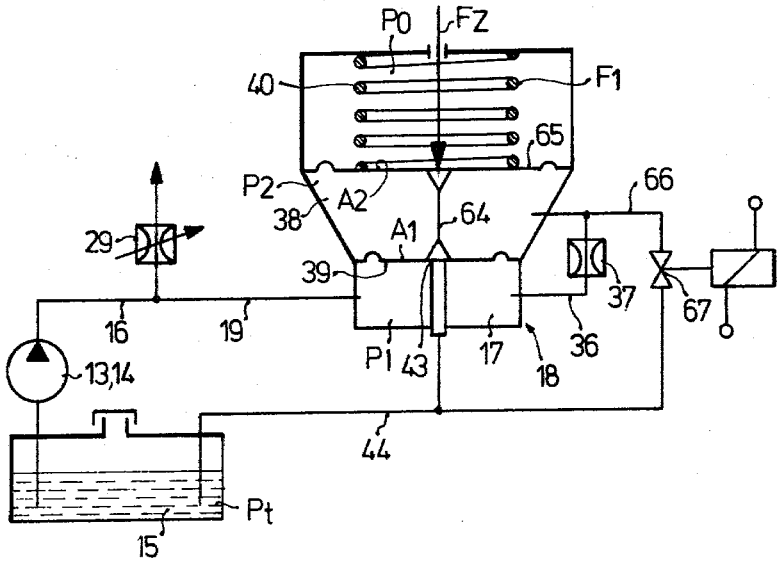
FIG. 4 is a view similar to FIG. 3 showing a third embodiment of the fuel pressure control means of the invention.

In the third embodiment as shown in FIG. 4, the control chamber 38 of the pressure regulating valve 18 has a diaphragm 65, connected with the diaphragm 39 by a holder 64, the diaphragm 65 having a surface area $A_2$ greater than the surface area $A_1$ of diaphragm 39. The spring 40 can contact the diaphragm 65 outside the pressure regulating valve 18 and urge the pressure regulating valve 18 in the closing direction via the holder 64. The control pressure chamber 38 communicates, via a control pressure line 66 having an electromagnetic valve 67 disposed therein, with the return flow line 44 to the fuel container 15. The electromagnetic valve 67 is controllable in accordance with the operating characteristics of the engine. When the magnetic valve 67 is closed, the pressure $p_o$ also prevails in the control pressure chamber 38, as it does in the chamber 17. Then only the diaphragm 65 is effective, and the pressure difference at the control slit 26 of the fuel apportionment valve 29 is:

$$p_1-p_o=F_1/A_2.$$

When the electromagnetic valve 67 is open, the tank return pressure $p_t$ is effective in the control pressure chamber 38. This pressure $p_t$ is determined by the hydraulic resistance of the return flow lines and a possible tank overpressure resulting from damped fuel. Then the pressure difference at the control slit 26 is:

$$p_1-p_o=F_1/A_1-(p_t-p_o)\,(A_2-A_1)\,A_1.$$

When $p_t=p_o$, which is approximately equal to atmospheric pressure, then $p_1-p_o=F_1/A_1$. That is, the two pressure limits are determined by the surface areas $A_1$ and $A_2$ of the diaphragms. The actuation of the electromagnetic valve 67 can again be accomplished cyclically in accordance with operating characteristics of the engine. At the same time, a supplementary force $F_z$ dependent on operating characteristics of the engine may be exerted on the diaphragm 65.

Figure 5:
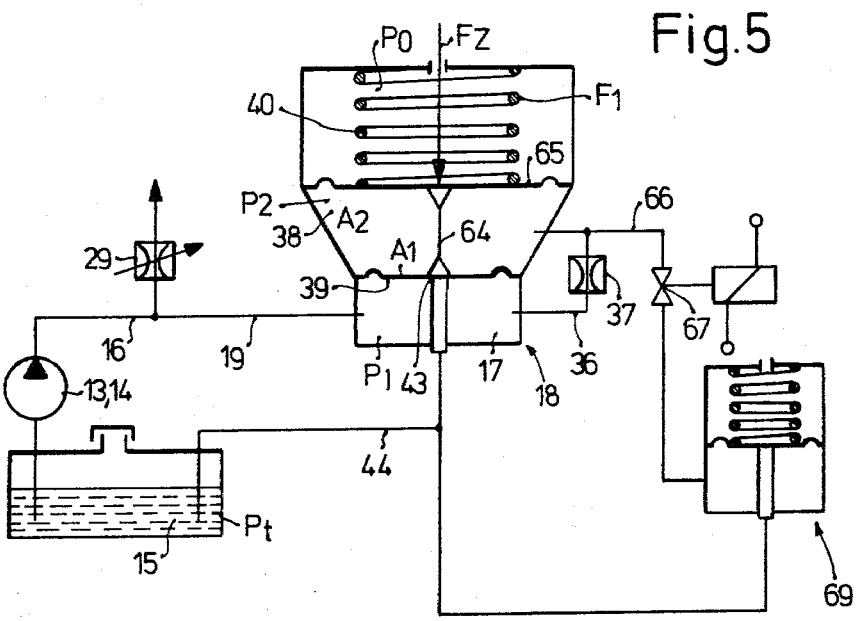
FIG. 5 is a view similar to FIG. 3 showing a fourth embodiment of the fuel pressure control means of the invention.

The exemplary embodiment of FIG. 5 differs from that of FIG. 4 solely in that a control pressure regulating valve 69 is disposed in the control pressure line 66 downstream of the electromagnetic valve 67. This valve 69 is identical in structure to the control valve 52 of FIGS. 2 and 3 and serves to simulate a constant return flow pressure, so that when the electromagnetic valve 67 is opened, the pressure prevailing in the control pressure chamber 68 is independent of pressure fluctuations in the return line 44.

Figure 6:
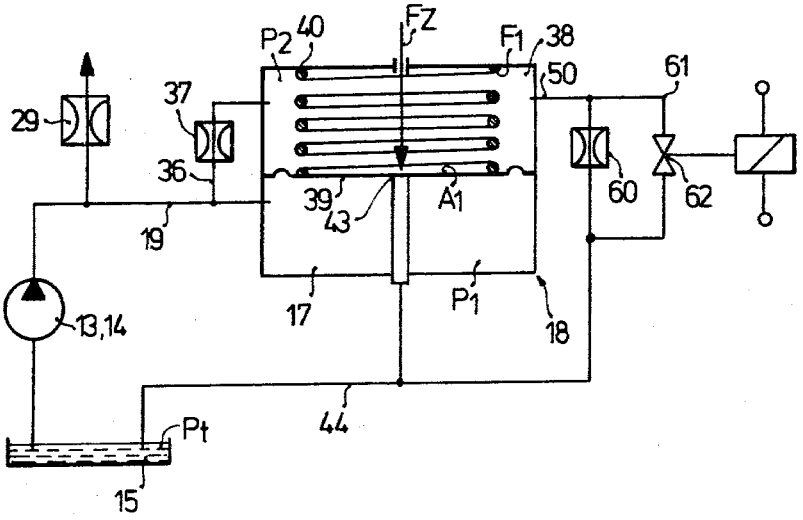
FIG. 6 is a view similar to FIG. 3 showing a fifth embodiment of the fuel pressure control means of the invention.

In the fifth embodiment shown in FIG. 6, there is no control valve 52 as in the embodiment of FIG. 3. Thus when the electromagnetic valve 62 is opened, the pressure $p_2$ in the control pressure chamber 38 is equal to the tank return pressure $p_t$, while, when the electromagnetic valve 62 is closed, the pressure is $p_2=p_1-K(p_1-p_t)$, where K determines which portion of the pressure $(p_1-p_t)$ falls at the throttle point 37. The electromagnetic valve 62 is cyclically actuated in accordance with operating characteristics of the engine. At the same time, however, a supplementary force $F_z$ may be exerted on the diaphragm 39 in accordance with other operating characteristics of the engine; this may be provided, as an example, by an element which operates in accordance with temperature in order to enrich the fuel-air mixture during the warm-up phase of the internal combustion engine.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system for mixture-compressing, externally ignited internal combustion engines comprising a fuel apportionment valve controllable by an air flow rate meter with the fuel pressure being variable upstream of the apportionment point by means of a pressure regulating valve, said pressure regulating valve including two chambers and a movable valve member for separating said two chambers, means including a throttle point for establishing communication between said two chambers, said movable valve member being arranged to be acted upon on one side by the fuel pressure upstream of said fuel apportionment valve and a spring for applying a force on the other side of said movable valve member, and a control element for also applying a variable control pressure to said movable valve member other side in accordance with the operating characteristics of the internal combustion engine.

2. A fuel injection system in accordance with claim 1, wherein said control element comprises a control valve, said control valve having a movable valve member adapted to be acted upon on one side by said control pressure, a spring for applying a force to the other side of said control valve movable valve member and means for also applying a supplementary force which is dependent on the operating characteristics of the internal combustion engine.

3. A fuel injection system in accordance with claim 2, including a control pressure line having a throttle point between said pressure regulating valve and said control valve and a bypass line including a valve controllable in accordance with engine operating characteristics for bypassing said control pressure line throttle point.

4. A fuel injection system in accordance with claim 3, wherein said valve in said bypass line comprises an electromagnetically actuatable valve.

5. A fuel injection system in accordance with claim 1 wherein one of said chambers of said pressure regulating valve comprises a control pressure chamber and including a return flow line of lower pressure, means including a throttle point for communicating said control pressure chamber with said return flow line and a bypass line having a valve forming a control element which is controllable in accordance with engine operating characteristics for bypassing said throttle point.

6. A fuel injection system in accordance with claim 1, wherein one of said chambers of said pressure regulating valve comprises a control pressure chamber, said control pressure chamber having an elastic wall portion communicating with said movable valve member and having a surface area which is greater than that of said movable valve member, a return flow line of lower pressure and means including a controllable valve serving as a control element for connecting said control pressure chamber with said return flow line in accordance with engine operating characteristics.

7. A fuel injection system in accordance with claim 6, including a control pressure line for connecting said control pressure chamber with a said return flow line, and a control pressure valve disposed in said control pressure line downstream of said control element.

8. A fuel injection system in accordance with claim 1, including means for influencing the closing force on said movable valve member of said pressure regulating valve with a supplementary force in accordance with engine operating characteristics.

9. A fuel injection system in accordance with claim 1, wherein one of said chambers of said pressure regulating valve comprises a control pressure chamber and wherein said control element comprises a valve controllable in accordance with the operating characteristics of the engine, a bypass line for bypassing said throttle point, and including a valve disposed downstream of said control pressure chamber for regulating the return flow pressure.

* * * * *